US006668600B1

(12) United States Patent
Hansson

(10) Patent No.: US 6,668,600 B1
(45) Date of Patent: Dec. 30, 2003

(54) DISTRIBUTION DEVICE FOR A DEVICE FOR DEWATERING PULP

(75) Inventor: Stefan Hansson, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 134 days.

(21) Appl. No.: 09/979,649

(22) PCT Filed: May 30, 2000

(86) PCT No.: PCT/SE00/01108

§ 371 (c)(1),
(2), (4) Date: Feb. 28, 2002

(87) PCT Pub. No.: WO00/75419

PCT Pub. Date: Dec. 14, 2000

(30) Foreign Application Priority Data

Jun. 4, 1999 (SE) ..... 9902061

(51) Int. Cl.[7] ..... D06B 5/14
(52) U.S. Cl. ..... 68/43; 68/200; 68/181 R
(58) Field of Search ..... 8/156; 68/200, 68/43, 181 R, 18 F, 158; 162/272, 348, 385, 315, 382; 210/326

(56) References Cited

U.S. PATENT DOCUMENTS 3,263,598 A * 8/1966 Sylla
3,720,578 A * 3/1973 Heling et al.
3,980,518 A * 9/1976 Ljung et al.
4,031,013 A * 6/1977 Skretting
4,388,938 A * 6/1983 Dubowik
4,670,099 A * 6/1987 LaValley
4,697,292 A * 10/1987 LaValley
4,782,747 A * 11/1988 Unger et al.
4,952,314 A * 8/1990 Henricson et al.
5,589,035 A * 12/1996 Sundqvist
5,667,642 A * 9/1997 Luthi
6,461,505 B1 * 10/2002 Danielsson et al.
6,521,094 B2 * 2/2003 Lamas et al.

* cited by examiner

*Primary Examiner*—Frankie L. Stinson
(74) *Attorney, Agent, or Firm*—Rolf Fasth; Fasth Law Offices

(57) ABSTRACT

A device for washing and dewatering a fiber pulp suspension. The device has two hollow, circular-cylindrical screen members that contain evacuation chambers for conducting away liquid. The screen members rotate towards each other for the purpose of forming a nip. At least one of the screen members is arranged in a trough which partially encloses the casing and which converges towards the casing in the direction of rotation of the screen member. At least one pulp inlet box is arranged at the highest point of the screen members for the purpose of introducing pulp between the casing the trough. The pulp inlet box is provided with a pressure equalization section in which a certain equalization of irregularities in pulp qualities takes place before the pulp is fed into the actual washing or dewatering gap.

7 Claims, 2 Drawing Sheets

DISTRIBUTION DEVICE FOR A DEVICE FOR DEWATERING PULP

PRIOR APPLICATIONS

This application is a U.S. national phase application based upon International Application No. PCT/SE00/01108, filed May 30, 2000; which claims priority from Swedish Application No. 9902061-2, filed Jun. 4, 1999.

TECHNICAL FIELD

The present invention relates to a distribution device for dewatering pulp.

BACKGROUND AND SUMMARY OF THE INVENTION

When producing paper pulp from cellulose-containing fiber material, there is a need to wash and dewater the paper pulp at one or more points in the process.

A previously known and frequently employed device, termed a wash press, for washing and dewatering paper pulp is shown in SE-C-380 300, SE-C-501 710, U.S. Pat. No. 5,488,900 and SE-C-504 011. The devices which are shown in these publications comprise two cylindrical, rotatable screen members which are arranged in a trough which is in the main convergent but which is partially divergent at the intake for washing liquid. Other examples of known devices are shown in U.S. Pat. No. 4,543,161 and U.S. Pat. No. 5,667,642, with the latter constituting a device in which the screen members rotate in the opposite direction to the conventional direction, i.e., when seen from a short side, the right screen member rotates anticlockwise and the left rotates clockwise.

A problem associated with devices of the prior art, which possess two cylindrical screen members which can be rotated towards each other, is that of obtaining an efficient initial distribution of pulp over the whole of the length of the dewatering device. An example of how this problem has been solved in shown in SE-C-500 546, in which a crescent is to distribute the pulp over a line by means of conducting the pulp from a punctate inlet and over the edge of the crescent. The lowest height of the crescent is obtained furthest away from the inlet and consequently a longer supply distance is compensated by a lower bridging height. In these types of solution, practical limits have been set at pulp concentrations of the order of 8%.

Other solutions have instead employed a distribution screw, similar to U.S. Pat. No. 4,559,104, which distribution screw provides a substantially improved initial distribution over the whole of the width of the wash press.

A good initial distribution of the pulp over the whole of the width of the wash press is a very important parameter for succeeding in obtaining a wash press which possesses high operability, i.e., which does not plug up, with the press subsequently having to be stopped in order to remove plugs, and a high dewatering ability. Ways of dealing with the problems involved in assisting uniform distribution of the pulp over the whole of the width of the wash press have exclusively concentrated on solutions corresponding to SE-C-500 546 or U.S. Pat. No. 4,559,104, and it has only been possible to discern any improvements in the transitions between pulp inlet boxes and trough sweeps in the form of shorter radii between the pulp inlet boxes and the trough sweeps, corresponding, for example, to U.S. Pat. No. 5,667,642.

In some wash presses, use has instead been made of a very long, gradual decrease in the gap from the inlet box, see, for example, SE 380 300. While this provides an equalizing effect, this very lengthy dewatering and equalizing zone at the same time results in a reduced total displacement ability. That is to say that the washing liquid which is to penetrate through the pulp web is given a much shorter stretch to act on, and the pulp web which is to be washed becomes thicker. An inferior displacement ability results in higher residual contents of chemicals in the pulp, something which is a negative feature, chiefly from the environmental point of view and from the point of view of recovery.

One object of the present invention is to provide a wash press whose operability is improved and which can be fed with high concentrations of pulp without there being any risk of it plugging up. When use has been made of a pulp inlet box in accordance with the invention, with the inlet box being employed for a wash press having double circular-cylindrical screen members and pulp inlet boxes at the highest point of the screen member, good operability has been obtained with pulp concentrations of the order of 12% in the inlet.

An additional object is for the pulp web to be relatively rapidly reduced in thickness, thereby providing the possibility of improved washing, i.e., improved displacement ability. It is important to be able to use new washing liquid to rapidly displace the chemicals which are present in the pulp, with these chemicals being returned, where appropriate, to the preceding stage in the pulp preparation process.

BRIEF DESCRIPTION OF THE DRAWINGS

The invention will be described below with reference to the figures, of which:

shows a distribution device according to the invention which is implemented in a wash press and which is seen in cross section; and shows the distribution device according to the invention on a larger scale.

DETAILED DESCRIPTION

Figure 1:
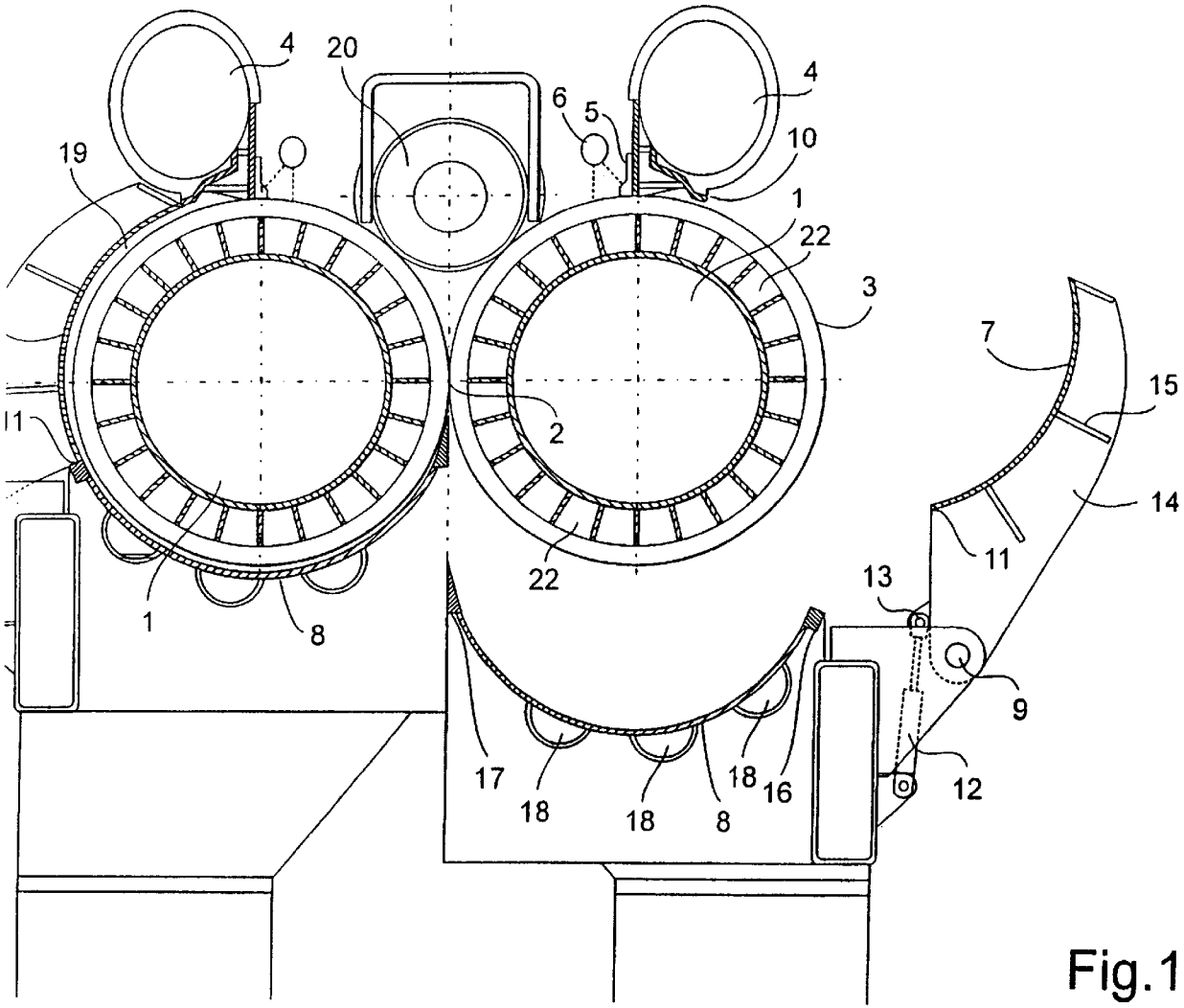

The preferred embodiment of the device according to the invention is shown in FIG. 1 and comprises two hollow, circular-cylindrical screen members 1 which contain a number of evacuation chambers, under the casing surface of the screen member, for conducting away evacuated liquid. The two screen members form a press nip 2 between each other and are arranged to rotate towards each other, with, when seen from the short side, the right screen member rotating clockwise and the left screen member rotating counterclockwise. Since the device is in the main symmetrical in a plane of symmetry which is formed by a tangent to the screen members 1 in the nip 2, only one of the symmetrical parts will in principle be described from now on.

The diameter of the screen member 1 is expediently 1.0–2.5 meters. Its casing 3 is furthermore perforated in order to enable liquid to be evacuated from a fiber pulp web which abuts the casing surface and then on into individual evacuation chambers 22, which conduct evacuated liquid away in an axial direction in the screen member. The evacuation chambers 22 communicate with each other by channels, which run in a peripheral direction, being formed between supports (not shown) which are arranged directly under the screen plating resting against the axially directed evacuation chambers.

In the preferred embodiment which is shown in FIG. 1, a pulp inlet box 4 is arranged at each screen member 1. Each pulp inlet box 4 is arranged at 0° in relation to the screen member, with 0° being the highest/topmost point of the screen member and the number of degrees increasing positively in the direction of rotation of the screen member. The inlet box distributes the incoming paper pulp, which concentration is normally about 1–12%, expediently 3–10%, uniformly over the length of the screen member. A longitudinal gasket 5, which bears against the casing 3 of the screen member and which prevents liquid running from the incoming pulp suspension, against the direction of rotation, and down into outgoing pulp which has already been dewatered, is arranged at the rear edge of the inlet box. A spray 6 is arranged to wash away fibers which may possibly collect on the gasket 5 and to clean the holes or slits in the casing 3 of the screen member. The gasket 5 is expediently constructed such that some fibers which may remain on the screen member are allowed to pass beneath the gasket but nevertheless such that it provides good sealing against the pulp in the inlet box 4.

In the preferred embodiment shown in FIG. 1, a trough is furthermore arranged, which trough consists, for each screen member 1, of at least two trough sweeps 7, 8. The top trough sweep 7 encloses the casing of the screen member from the pulp inlet box 4, where, in the operating position, the top trough sweep is in the main arranged so that it seals against the pulp inlet box, or as shown, against a short piece of the top trough sweep 10, which is built as one piece with the pulp inlet box.

In the preferred embodiment, the top trough sweep has a lower end point 11 at about 115° (in the operating position) and can be pivoted around an axle 9, which axle is parallel to the casing surface 3 of the screen member and is arranged in the vicinity of the said end point 11. When the top trough sweep is to be pivoted, for access for, for example, cleaning the screen member, a hydraulic cylinder 12 folds the trough sweep outward by way of a lever arm between the axle 9 and the attachment point 13 of the hydraulic cylinder in the top trough sweep. The top trough sweep is reinforced with external flanges 14, which number is expediently matched to the width of the trough, which extend along the circle segment of the top trough sweep 7 and which are provided with additional reinforcing, transverse struts 15.

At the end point 11 of the top trough sweep, it bears, in the operating position, in a sealing manner against the bottom trough sweep 8. In this context, the bottom trough sweep 8 extends from the end point of the top trough sweep, along the casing surface 3 and through to the nip 2. It will be understood that the bottom trough sweep 8 cannot reach right into the nip, in association with which it expediently finishes in a position at which the distance between the two screen members 1 corresponds to about twice the gap width in the end point of the bottom trough sweep 8. A number of washing zones 18, which contain inlets (not shown) for washing liquid, are arranged in the bottom trough sweep 8. In the embodiment shown, three longitudinal washing zones 18 have been arranged at about 140°, 170° and 200°, respectively. While the number of washing zones is matched to each respective application, 2–3 washing zones are normally employed between approximately 115° to approximately 200°. The bottom trough sweep 8 can be lowered for access and cleaning the casing 3 of the screen member. The bottom trough sweep 8 is lowered using a suitable device, preferably a hydraulic positioning device.

A gap 19 is present between the casing surface 3 of the screen member and the trough 7, 8, which gap is arranged to converge from the pulp inlet box 4 to the nip 2, with, however, it being possible for divergent areas to occur in places, for example at washing zones 18, where washing liquid is to be introduced into the fiber pulp web which is present in the gap. The width of the gap between the walls of the trough and the casing 3 can be regulated so as to achieve optimal dewatering and is adjusted depending on the concentration of the incoming fiber pulp and the desired degree of dewatering. At the inlet, the gap width is typically of the order of size of 50–150 millimeters, while the gap width at the outlet is typically of the order of size of 10–40 millimeters. Above the nip 2 is arranged a stripper and conveyor worm 20 which strips off the washed and dewatered fiber pulp web and conveys it away for further treatment in the process for manufacturing paper pulp. Alternatively, or as a complementary addition, a scraper can also be used for detaching the fiber pulp web from the casing 3.

During operation, a paper pulp which concentration is about 1–12% is conducted into the gap 19 via the pulp inlet box 4. The invention is now described in more detail with reference to FIG. 2, which shows the essential features of the invention. The pulp inlet box 4 distributes the pulp over the whole width of the wash press, in a manner known per se using a distribution screw corresponding to that shown in U.S. Pat. No. 4,559,104, after which it is fed down towards the circular-cylindrical casing surface of the screen member, via the gap 30, to a first section. The gap 30 is open radially outward towards the pulp inlet box such that pulp can be conducted to the gap 30 continuously. Directly after this initial supply of the pulp to section 1, a second section of the distribution device begins, which second section is closed at a first distance (A) calculated from the casing surface of the screen member and in a radial direction out from the center of rotation of the circular-cylindrical screen member.

The second section is arranged after the first section, seen in the direction of rotation of the screen member. In this second section, the pulp is equalized over the width of the wash press while continuously being drawn in towards the trough gap. The distance between the casing of the screen member and the radially external delimitation surface corresponds to the distance (A) in FIG. 2, and, at least at the beginning of the equalization zone in the second section, this distance is at least 50% greater than that of the subsequent trough sweep gap (B). The distance (A) is expediently adjusted to the prevailing pulp concentrations, with (A) as a rule decreasing as the concentration of the pulp which is conducted to the gap 30 increases. However, it is expedient for the first distance (A) to be within the interval 150–800% of the second distance (B) and preferably 500%. In order to ensure that a good equalization effect is obtained, the equalization section should also extend peripherally over an angular distance $\alpha$ which exceeds 5°.

The angular distance $\alpha$ expediently lies within the interval 5–30°, preferably 20°. Too long an equalization zone results in the available washing and displacement zones decreasing, and the size of the equalization zone is consequently a compromise between a good initial distribution and washing and displacement results.

The screen members 1 are arranged to rotate at a speed of 5–20 rpm using a suitable drive device. The paper pulp then accompanies the rotation of the screen members, passing into the gap 19 between the perforated casing surface 3 and the walls of the trough 7, 8, in association with which it forms a fiber pulp web which is dewatered due to the gap converging in the direction towards the nip. The liquid which is pressed out of the fiber pulp web is conducted away (not shown) from the device. Washing liquid is introduced into the fiber pulp web at the washing zones 18, where the gap can be somewhat divergent, with washing of the web then taking place. Finally, the pressure in the nip 2 dewaters the fiber pulp web to a concentration which is about 5–20 times higher than the concentration of the incoming paper pulp, for example 1–12% when supplied and 25–40% after the nip. The stripper and conveyor worm 20 strips the fiber pulp web off the casing 3 and conveys it away from the device.

Figure 2:
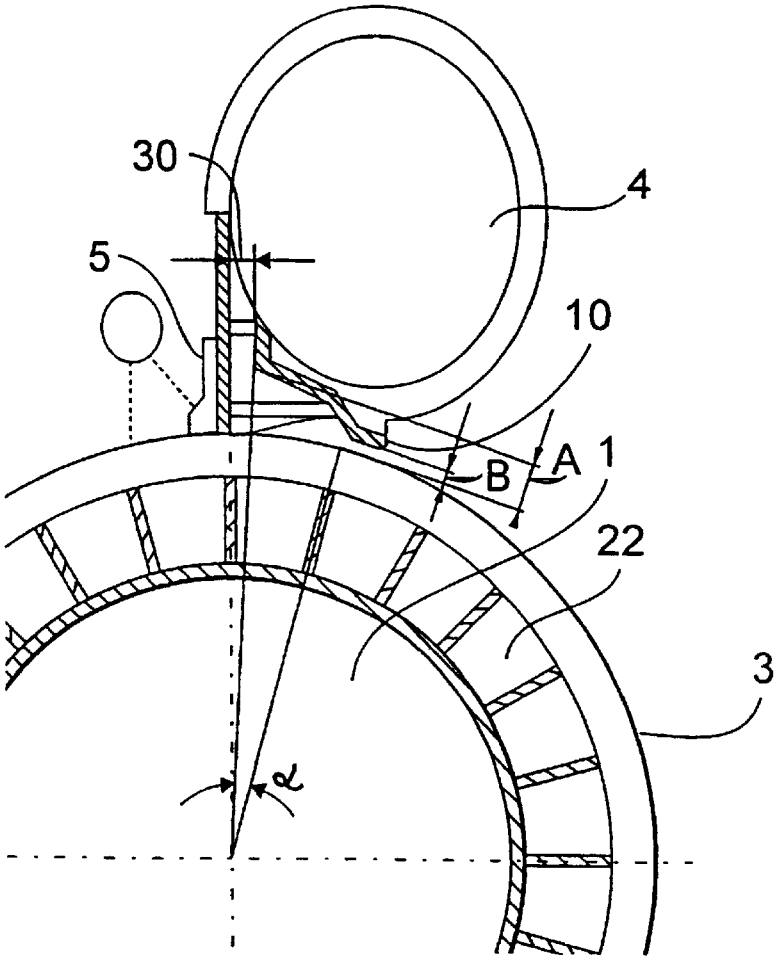

The device according to the invention is not limited by the embodiments which are described above but can be varied within the scope of the subsequent patent claims. For example, the radially external delimitation wall of the equalization zone can consist of smooth sheet metal, with the distance (A) being continuously reduced to the distance (B) over the equalization zone. The equalization zone can also, as shown in FIGS. 1 and 2, be provided with a radially external delimitation wall which, at one bound, half-way into the equalization zone, is angled off more sharply, resulting in a more rapid reduction in the gap being obtained during the later phase of the equalization zone.

While the present invention has been described in accordance with preferred compositions and embodiments, it is to be understood that certain substitutions and alterations may be made thereto without departing from the spirit and scope of the following claims.

What is claimed is:

1. A device for washing and dewatering a fiber pulp suspension, comprising:

a first circular-cylindrical screen member in rotatable operative engagement with a second circular-cylindrical member to form a nip, the first screen member being hollow to permit evacuation of a liquid in a radial inward direction into the first screen member;

the first screen member being disposed in a trough that partially encloses a casing of the first screen member, the trough converges towards the casing in a direction of rotation of the first screen member, the casing having a casing surface;

a pulp inlet box arranged at the first screen member for introducing pulp into a gap defined between the casing and the trough for forming a fiber pulp web, the pulp inlet box having a first section having an outwardly radial opening defined therein for receiving pulp conducted to the pulp inlet box;

the pulp inlet box containing a closed second section that is disposed a first distance (A) from the casing surface in a radially outward direction from a center of rotation of the first screen member, the second section being disposed after the first section in a rotational direction of the first screen member, the second section continuously merging, to equalize a pressure of the pulp over a width of a wash press, into a trough sweep arranged initially at a second distance (B) from the casing surface after the second section in the rotational direction of the first screen member so that an equalization zone created in the second section is being reduced at a greater rate at an end segment of the equalization zone; and the first distance (A) being at least 50% greater than the second distance (B) and the second section extending over at least 5° over a periphery of the first screen member.

2. The device according to claim 1 wherein the second section extends over the periphery of the first screen member within a peripheral angle between 5–30 degrees.

3. The device according to claim 2 wherein the peripheral angle is about 20 degrees.

4. The device according to claim 1 wherein the first distance (A) is 150–800% greater than the second distance (B).

5. The device according to claim 4 wherein the first distance (A) is 300% greater than the second distance (B).

6. The device according to claim 1 wherein the second section continuously merges into the trough sweep.

7. The device according to claim 1 wherein the pulp inlet box is arranged to connect to a highest point of the first screen member.

* * * * *